US005927237A

United States Patent [19]

Komatsu et al.

[11] Patent Number: 5,927,237

[45] Date of Patent: Jul. 27, 1999

[54] VALVE OPERATING SYSTEM IN INTERNAL COMBUSTION ENGINE

[75] Inventors: Yasuyuki Komatsu; Harumi Hatano; Kouichi Ikoma; Minoru Nakamura, all of Saitama, Japan

[73] Assignee: Honda Giken Kogyo Kabushiki Kaisha, Tokyo, Japan

[21] Appl. No.: 08/908,735

[22] Filed: Aug. 7, 1997

[30] Foreign Application Priority Data

Aug. 8, 1996 [JP] Japan ..... 8-209491

[51] Int. Cl.[6] ..... F01L 9/04; F16K 31/06

[52] U.S. Cl. ..... 123/90.11; 251/129.01; 251/129.19

[58] Field of Search ..... 123/90.11; 251/129.01, 251/129.02, 129.05, 129.1, 129.15, 129.16, 129.19

[56] References Cited

U.S. PATENT DOCUMENTS 4,719,882 1/1988 Kreuter ..... 123/90.11
5,711,259 1/1998 Pischinger et al. ..... 123/90.11

FOREIGN PATENT DOCUMENTS 2 137 420 10/1984 United Kingdom .
WO 95/00959 1/1995 WIPO .

*Primary Examiner*—Weilun Lo
*Attorney, Agent, or Firm*—Lyon & Lyon LLP

[57] ABSTRACT

A valve operating system in an internal combustion engine which provides a stable seating force for an engine valve and includes an armature operatively connected to a stem of the engine valve that is capable of being seated on a valve seat member provided to a cylinder head, valve-opening and valve-closing electromagnets for exhibiting electromagnetic forces for attracting the armature to open and close the engine valve, respectively, and valve-opening and valve-closing resilient means for exhibiting resilient forces for biasing the engine valve in opening and closing directions, respectively, and for retaining the armature in a predetermined neutral position by cooperation with each other during deenergization of both the valve-opening and valve-closing electromagnets. When the engine valve V is closed by energizing the valve-closing electromagnet and is seated on the valve seat member, only the resilient force of the valve-closing resilient means is applied to the engine valve V because the valve-closing electromagnet attracts the armature and compresses the valve-opening resilient means.

8 Claims, 7 Drawing Sheets

VALVE OPERATING SYSTEM IN INTERNAL COMBUSTION ENGINE

The present invention relates to a valve operating system in an internal combustion engine and, in particular, to a valve operating system that includes a valve seat member mounted in a cylinder head to define a valve bore, an armature operatively connected to a stem of an engine valve capable of being seated on the valve seat member, a valve-opening electromagnet for exhibiting an electromagnetic force of attracting the armature to open the engine valve, a valve-closing electromagnet for exhibiting an electromagnetic force for attracting the armature to close the engine valve, a valve-opening resilient means for exhibiting a resilient force for biasing the engine valve in an opening direction, and a valve-closing resilient means for exhibiting a resilient force for biasing the engine valve in a closing direction and for retaining the armature in a predetermined neutral position by cooperation with the valve-opening resilient means during deenergization of the valve-opening and closing electromagnets.

BACKGROUND OF THE INVENTION

Such a valve operating system is conventionally known, for example, from PCT International Patent Application Laid-open No.WO95/00959 and the like.

In the valve operating system disclosed in the above PCT Internationial Patent Application, the armature is fixed to the upper end of the stem of the engine valve, and in order to provide a reliable seated state of the engine valve, even if an elongation of the stem is produced due to the thermal expansion, a gap is created between the valve-closing electromagnet and the armature in the seated state of the engine valve.

However, the seating force for the engine valve on the valve seat member depends on the electromagnetic force of the valve-closing electromagnet, and the seating force is varied substantially by a variation in the electromagnetic force due to a variation in value of a current supplied to energize the valve-closing electromnagnet.

The present invention has been accomplished with such circumstances in view, and it is an object of the present invention to provide a valve operating system in an internal combustion engine wherein a stable seating force for the engine valve is provided irrespective of the elongation of the stem and the variation in current supplied to the valve-closing electromagnet.

To achieve the above object, according to the present invention, the valve-operating system is constructed so that only the resilient force of the valve-closing resilient means is applied to the engine valve when the engine valve is seated on the valve seat member. Thus, the seating force for the engine valve is determined by the resilient force of the valve-closing resilient means and hence, a stable seating force can be provided.

According to the present invention, the resilient force of the valve-opening resilient means is applied to the armature to stop the application of the resilient force to the engine valve with attraction of the armature toward the valve-closing electromagnet, and the resilient force of the valve-closing resilient means is applied to the stem which is capable of being axially moved relative to the armature during attraction of the armature toward the valve-closing electromagnet. Thus, only the resilient force of the valve-closing resilient means is applied to the stem of the engine valve with attraction of the armature toward the valve-closing electromagnet by the energization of the valve-closing electromagnet. Therefore, the seating force for the engine valve can be determined by the resilient force of the valve-closing resilient means without the need for a complicated control.

According to the present invention, the armature and the stem are operatively interconnected through a connecting means which is adapted to enable the armature and the stem to be moved in unison with each other during closing of the engine valve, until the engine valve is seated on the valve seat member, but to permit the armature to be moved toward the valve-closing electromagnet in the axial movement relative to the stem after stoppage of the movement of the stem as a result of seating of the engine valve. Therefore, after seating of the engine valve, the armature can be moved toward the valve-closing electromagnet with the stem remaining in the valve-seated position, and the transmission of the force from the armature can be cut off from the engine valve, so that the seating force can be provided by only the resilient force of the valve-closing resilient means applied to the stem.

Further, according to the present invention, the connecting means includes a bottomed cylindrical cap which is fixed to an upper end of the stem, so that it can be engaged with the armature from the side opposite from the valve-closing electromagnet and which is fitted into the armature for axial relative sliding movement. Therefore, the outer peripheral surface of the cap can be easily formed as a slide surface by machining.

Still further, according to the present invention, the connecting means includes a bottomed cylindrical cap which is formed into a bottomed cylinder-like configuration and fixed to the armature and into which an upper portion of the stem is slidably fitted. Therefore, the cap and the armature are in a state in which they are supported by the upper portion of the stem during movement of the armature toward the valve-closing electromagnet, and hence, it is possible to prevent the deflection of the armature to stably attract the armature to the valve-closing electromagnet.

Furthermore, according to the present invention, the cap has an opened bore in its closed end. Therefore, it is possible to avoid the pressurization and depressurization of a space created between the cap and the stem slidably fitted in the cap, and to prevent the stem from being attracted upwards when the volume of the space is increased during closing of the engine valve, thereby preventing an increase in seating force.

Also according to the present invention, the distance through which the armature is moved toward the valve-closing electromagnet after seating of the engine valve is set at a value equal to or larger than the maximum amount of elongation of the stem due to the thermal expansion of the engine valve. Therefore, it is possible to cope with the thermal expansion of the engine valve to ensure the normal operation of the engine valve at an increased temperature.

DESCRIPTION OF THE PREFERRED EMBODIMENTS

The mode for carrying the present invention will now be described in connection with the preferred embodiments by reference to the accompanying drawings.

Figure 1:
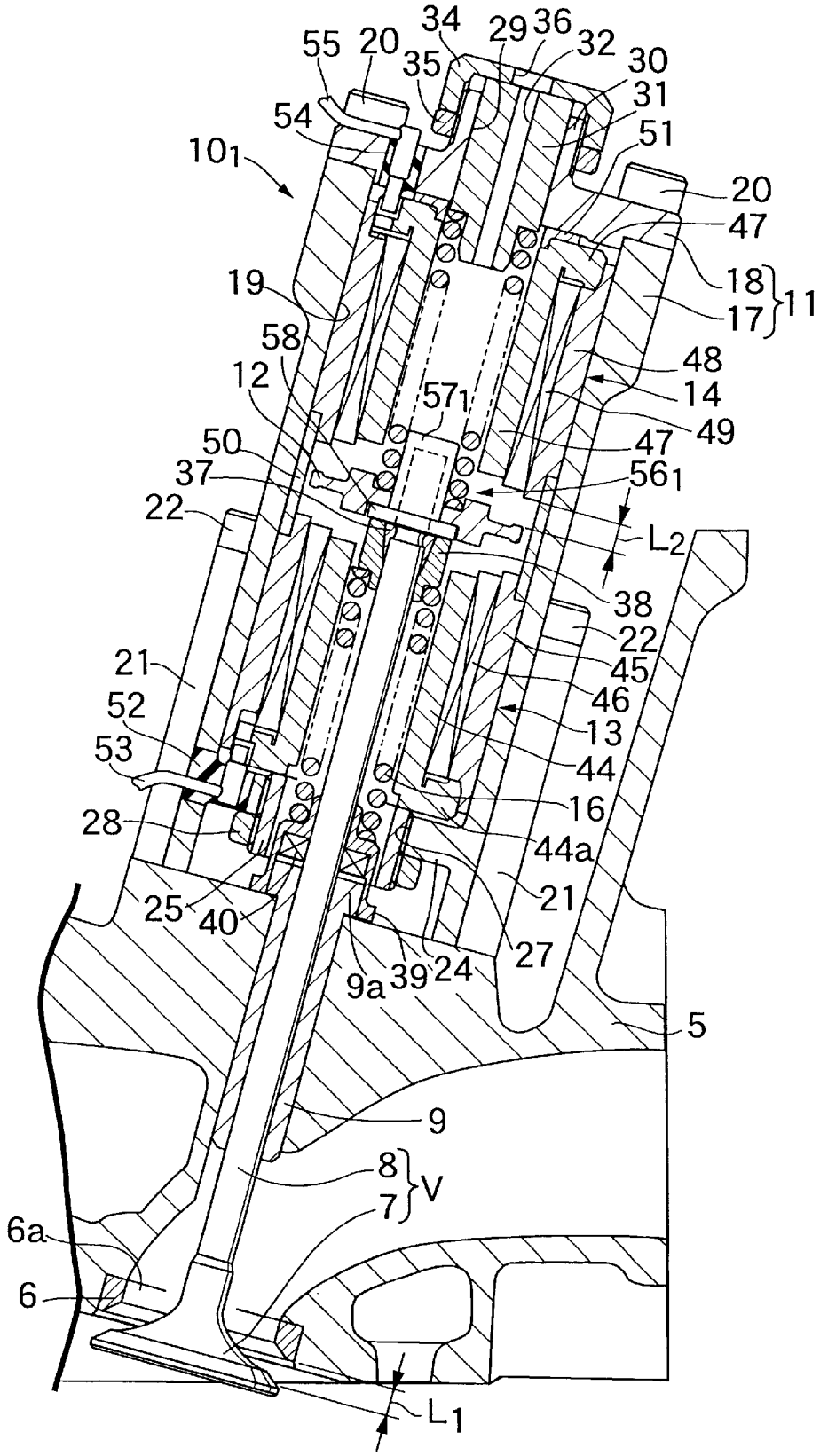
FIG. 1 is a vertical sectional view of a valve operating system in a condition in which an engine valve is in a neutral position in a first embodiment.

Referring, first to FIG. 1, an engine valve V which is either an intake valve or an exhaust valve is disposed in a cylinder head 5 of an internal combustion engine. The engine valve V is comprised of a valve member 7 capable of being seated on a valve seat member 6 which is provided in the cylinder head 5 to define a valve bore 6*a,* and a stem 8 integrally connected to the valve member 7 and slidably fitted within a guide tube 9. The guide tube 9 includes a radially outwardly protruding flange portion 9*a* at its upper end is fixed to the cylinder head 5 by press-fitting into the cylinder head 5 until the flange portion 9*a* is engaged with an upper surface of the cylinder head 5.

A valve operating system 10, according to the present invention is disposed on the cylinder head 5 and connected to an upper end of the stem 8 of the engine valve V.

The valve operating system $\mathbf{10}_1$ includes a casing 11 separatably coupled to the upper surface of the cylinder head 5, an armature 12 movably accommodated in the casing 11 and operatively connected to the stem 8 of the engine valve V, a valve-opening electromagnet 13 disposed within the casing 11 at a location in which it is opposed to a lower surface of the armature 12 to exhibit an electromagnetic force for attracting the armature 12 to open the engine valve V, a valve-closing electromagnet 14 disposed within the casing 11 at a location in which it is opposed to an upper surface of the armature 12 to exhibit an electromagnetic force for attracting the armature 12 to close the engine valve V, a valve-opening coil spring 15 as a valve-opening resilient means for exhibiting a resilient force for biasing the engine valve V in an opening direction, and a valve-closing coil spring 16 as a valve-closing resilient means for exhibiting a resilient force for biasing the engine valve V in a closing direction and for retaining the armature 12 at a predetermined neutral portion by cooperation with the valve-opening coil spring 15 during deenergization of the valve-opening and closing electromagnets 13 and 14.

The casing 11 is comprised of a casing body 17 extending coaxially with the stem 8 of the engine valve V to define an accommodating bore 19 with its upper end opened, and a lid plate 18 fixed to an upper surface of the casing body 17. The lid plate 18 is fastened to the upper surface of the casing body 17 by a plurality of bolts 20, so that it closes an upper end of the accommodating bore 19.

A plurality of vertically extending support sections 21 are integrally provided at a lower portion of an outer periphery of the casing body 17, and fastening bolts 22 are inserted through the support sections 21, respectively. The casing 11 is fastened to the upper surface of the cylinder head 5 by threaded fitting of the fastening bolts 22 into the cylinder head 5.

A support collar 24 is integrally provided at a lower portion of the casing 11, i.e., of the casing body 17 and protrudes radially inwards from an inner surface of the accommodating bore 19. A support tube 25 is threadedly engaged with female threads 27 provided on an inner periphery of the support collar 24 for advancing and retreating movements in a direction coaxial with the stem 8 of the engine valve V. A retaining nut 28 engaged with a lower surface of the support collar 24 is threadedly engaged with the exterior of the support tube 25. Thus, the support tube 25 can be firmly fixed to the support collar 24, i.e., the lower end of the casing 11 for advancing and retreating movements in the direction coaxial with the stem 8 by a double-nut structure formed by the threaded engagement of the support tube 25 with the support collar 24 and the threaded engagement of the retaining nut 28 with the support tube 25.

A cylindrical portion 30 defining a support bore 29 coaxial with the stem 8 is integrally provided at the upper end of the casing 11, i.e., on the lid plate 18 to protrude upwards. A cylindrical regulating member 31 is slidably fitted into the support bore 29 for movement in an axial direction of the stem 8 and has a through-hole 32 provided therein over its entire vertical length.

A cap nut 34 is threadedly fitted over the cylindrical portion 30, so that an upper end of the regulating member 31 abuts against a closed end of the cap nut 34, and a retaining nut 35 is threadedly fitted over the cylindrical portion 30 to limit the advanced or retreated position of the cap nut 34. Thus, the double-nut structure is formed by the cap nut 34 and the retaining nut 35, and the end of the axially outward movement of the regulating member 31 can be adjustably and firmly limited by regulating the advanced or retreated position of the cap nut 34. A hole 36 coaxially connected to the through hole 32 of the cylindrical regulating member 31 is provided on the closed end of the cap nut 34.

An upper portion of the stem 8 in the engine valve V is inserted from below into the casing body 17, so that it is coaxially passed through the support tube 25, and a retainer 38 is fixed to the upper end of the stem 8 by a split cotter 37. A cap-like receiving member 39 is mounted on the stem 8 to abut against the upper surface of the cylinder head 5 to cover the flange portion 9*a* of the guide tube 9. A valve-closing coil spring 16 is mounted between the retainer 38 and the receiving member 39 to surround the stem 8 axially movably passed through the receiving member 39, so that the stem 8, i.e., the engine valve V, is resiliently biased in a closing direction by the spring force of the valve-closing coil spring 16. Moreover, a ring-like seal member 40 in sliding contact with the outer surface of the stem 8 is retained within the receiving member 39.

The armature 12 is formed into a disk-like shape, and a valve-opening coil spring, 15 is mounted between the armature 12 and the regulating member 31, so that the armature 12 is resiliently biased downwards, i.e., in a direction of opening of the engine valve V.

The valve-opening electromagnet 13 is fixedly disposed in a lower portion of the accommodating bore 19, so that it is opposed to the lower surface of the armature 12. The valve-opening electromagnet 13 includes a cylindrical inner yoke 44 coaxially surrounding the stem 8 and the valve-closing coil spring 16, a cylindrical outer yoke 45 fitted in the accommodating bore 19 to coaxially surround the inner yoke 44, and a ring-like coil assembly 46 which has a coil wound around a bobbin made of a synthetic resin and which is fitted between the inner and outer yokes 44 and 45. A radially outward protruding flange portion 44*a* is integrally provided at a lower end of the inner yoke 44 and has an outer edge engaged with a lower end of the outer yoke 45.

The valve-closing electromagnet 14 is fixedly disposed in an upper portion of the accommodating bore 19, so that it is opposed to the upper surface of the armature 12. The valve-closing electromagnet 14 includes a cylindrical inner yoke 47 coaxially surrounding the regulating member 31, a cylindrical outer yoke 48 fitted in the accommodating bore 19 to coaxially surround the inner yoke 47, and a ring-like coil assembly 49 which has a coil wound around a bobbin made of a synthetic resin and which is fitted between the inner and outer yokes 47 and 48. A radially outward protruding flange portion 47*a* is integrally provided at an upper end of the inner yoke 47 and has an outer edge engaged with an upper end of the outer yoke 48.

A sleeve 50 is fitted into the accommodating bore 19 in a ring-like configuration to surround the armature 12 and interposed between the outer yoke 45 of the valve-opening electromagnet 13 and the outer yoke 48 of the valve-closing electromagnet 14. The lower end of the inner yoke 44 of the valve-opening electromagnet 13 is supported in an abutting manner on the upper end of the support tube 25. A shim 51 is interposed between the upper end of the inner yoke 47 of the valve-closing electromagnet 14 and the lid plate 18 of the casing 11. More specifically, the valve-opening and closing electromagnets 13 and 14 with the sleeve 50 interposed therebetween are fixed within the casing 11 by clamping thereof between the shim 51 disposed at the upper end of the casing 11 and the upper end of the support tube 25.

A grommet 52 is fitted in the lower end portion of the casing body 17 which corresponds to the support collar 24. A pair of lead wires 53 connected to the coil of the coil assembly 46 of the valve-opening electromagnet 13 are passed through the grommet 52 and extend outside the casing 11. A grommet 54 is fitted in the lid plate 18 and a pair of lead wires 55 connected to the coil of the coil assembly 49 of the valve-closing electromagnet 14 are passed through the grommet 54 and extend outside the casing 11.

The armature 12 and the stem 8 are interconnected through a connecting means $\mathbf{56}_1$ which is adapted to transmit a force between the armature 12 and the stem 8 during movement of the armature 12 toward the valve-opening electromagnet 13, but to cut off the transmission of the force during movement of the armature 12 toward the valve-closing electromagnet 14.

The connecting means $\mathbf{56}_1$ is adapted to enable the armature 12 and the stem 8 to be moved in unison with each other, until the engine valve V is seated on the valve seat member 6 during closing thereof, and to enable the armature 12 to be moved toward the valve-closing electromagnet 14 after seating of the engine valve V. The connecting means $\mathbf{56}_1$ includes a cap $\mathbf{57}_1$ which is fixed to the upper end of the stem 8, so that it can be engaged with the armature 12 from the side opposite from the valve-closing electromagnet 14, i.e., from below, and which is axially relatively slidably fitted into the armature 12.

The cap $\mathbf{57}_1$ is formed into a bottomed cylinder-like configuration having an engage collar portion 58 capable of engaging the lower surface of the armature 12 at its opened end, and is relatively slidably fitted into a central portion of the armature 12. The upper end of the stem 8 is fixed to the cap $\mathbf{57}_1$ by press-fitting, threads or the like.

Figure 2:
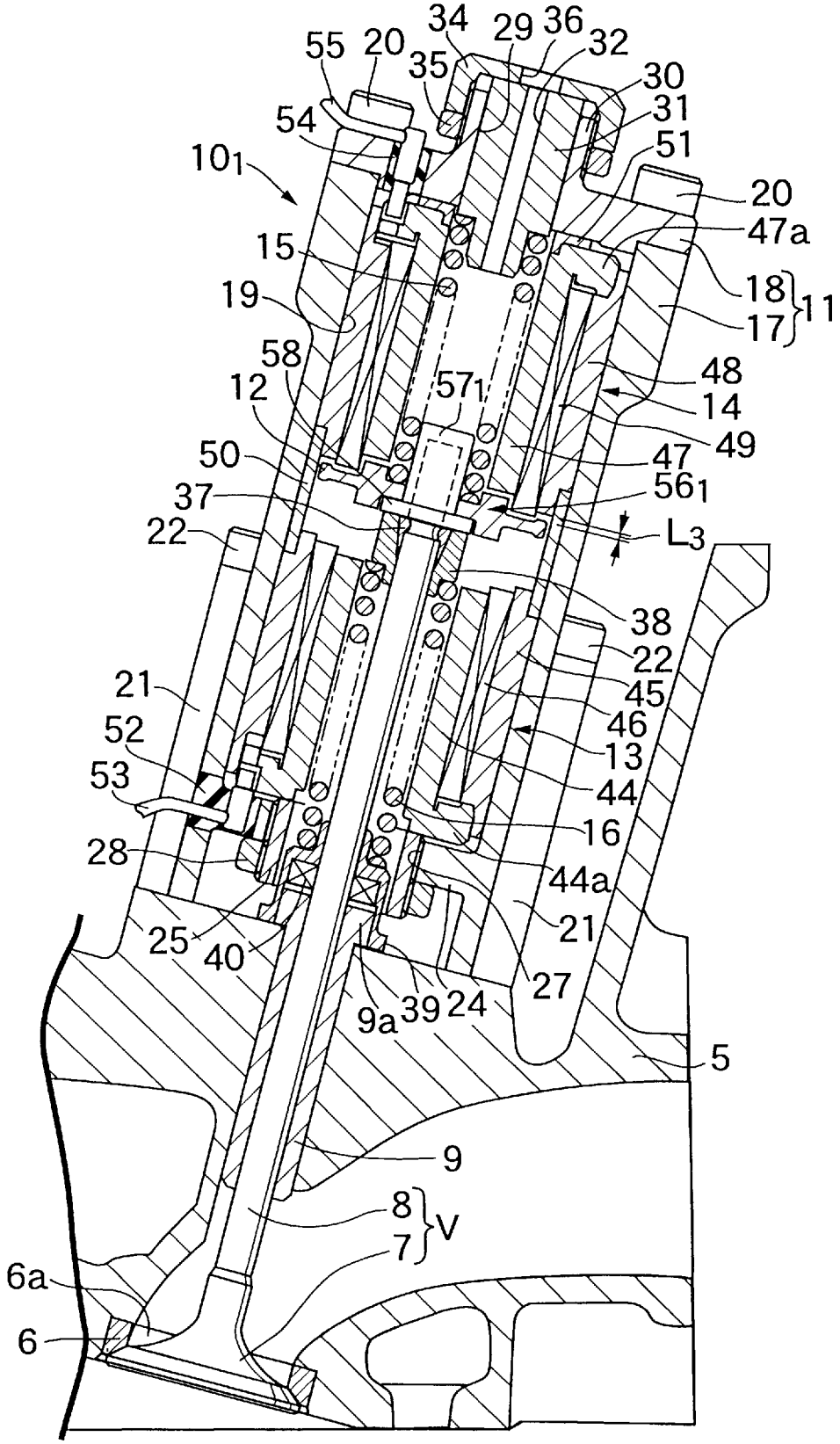
FIG. 2 is a vertical sectional view similar to FIG. 1, but in a condition in which the engine valve is in a seated state.
Figure 3:
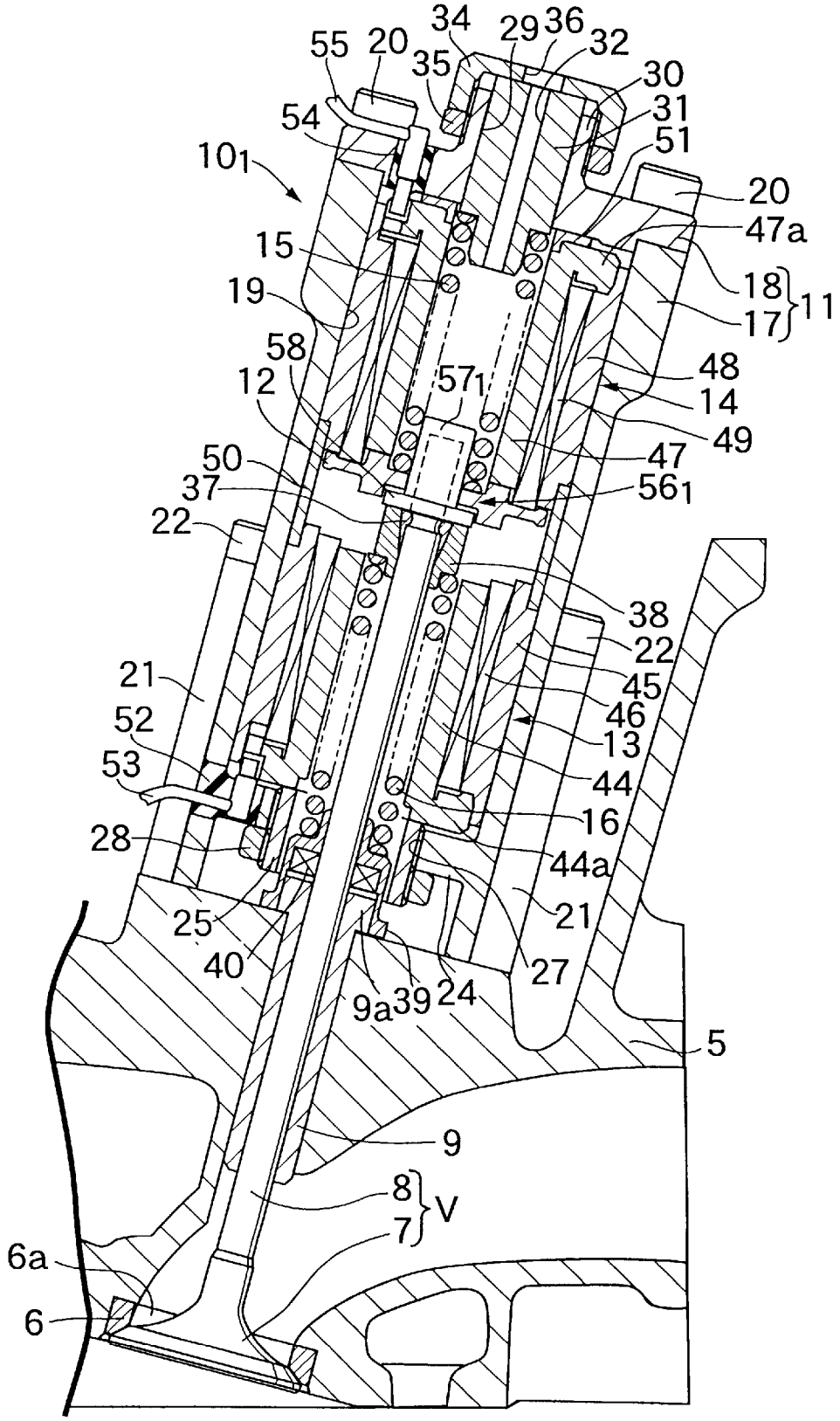
FIG. 3 is a vertical sectional view similar to FIG. 1, but in a condition in which an armature has been moved toward a valve-closing electromiaginet after seating of the engine valve.

If the distance from the neutral position of the engine valve V to the seating of the valve member 7 of the engine valve V on the valve seat member 6 is represented by $L_1$, the distance $L_2$ through which the armature 12 in the neutral position is moved until it becomes close to the valve-closing electromagnet 14, i.e., until it contacts with the valve-closing electromagnet 14, is set at a value equal to or larger than the distance $L_1$. That is, when the engine valve V is closed, there is distance $L_3(=L_2-L_1)$ created between the current position of the armature 12 at the time when the valve member 7 of the engine valve V is seated on the seat member 6, as shown in FIG. 2 and the limit position of armature 12 approaching the valve-closing electromagnet 14. After seating of the engine valve V on the valve seat member 6, the armature 12 can be moved through the distance $L_3$ toward the valve-closing electromagnet 14, with the stem 8 remaining in the valve-seated position, by the sliding movement relative to the cap $\mathbf{57}_1$, as shown in FIG. 3. This distance $L_3$ is set when the engine is cold at a value equal to or larger than a maximum amount of elongation of the stem 8 due to thermal expansion of the engine valve V.

Moreover, in a condition in which the armature 12 is in contact with the valve-closing electromagnet 14, as shown in FIG. 3, the spring force of the valve-opening coil spring 15 acting on the armature 12 as well as the electromagnetic force of the valve-closing electromagnet 14 cannot be applied to the stem 8, and only the spring force of the valve-closing coil spring 16 is applied to the stem 8, i.e., the engine valve V.

The assembly and operation of the first embodiment now will be described. The upper portion of the stem 8 of the engine valve V is capable of being inserted from below into the casing 11 coaxially through the support tube 25 at the lower end of the casing 11. The valve-opening and closing electromagnets 13 and 14 are fixed within the casing 11, and the cap $\mathbf{57}_1$, which is fixed to the upper end of the stem 8, is slidably fitted in the armature 12 so that cap $\mathbf{57}_1$ engages the lower surface of the armature 12 from below. The valve-opening coil spring 15 for biasing the engine valve V in the opening direction is mounted between the armature 12 and the regulating member 31 supported at the upper end of the casing 11, and is accommodated in the casing 11. The retainer 38 is fixed to the upper end of the stem 8, and the valve-closing coil spring 16 is mounted between the receiving member 39 located at a fixed position on the upper surface of the cylinder head 5 and the retainer 38.

Figure 4:
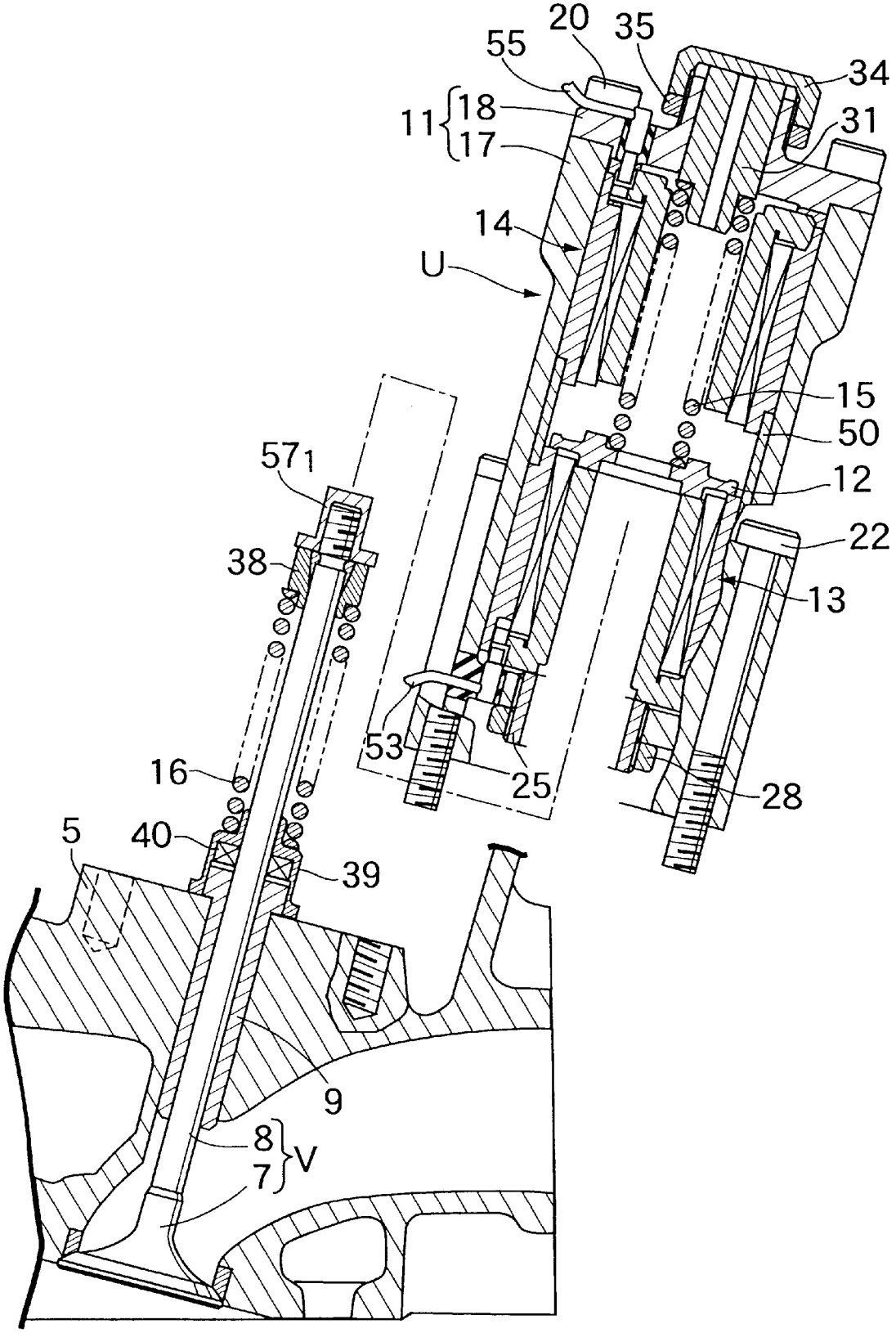
FIG. 4 is an exploded vertical sectional view of the valve operating system shown in a state during assembling.

Therefore, as shown in FIG. 4, the valve-opening and closing electromagnets 13 and 14, the armature 12, the valve-opening coil spring 15 and the like can be accommodated and disposed within the casing 11 to form a pre-assembled unit U. Thus, the pre-assembled unit U can be prepared by a previous assembling step conducted at a convenient location to avoid assembling those components in the narrow space above the cylinder head 5. In this pre-assembled unit U, the armature 12 is urged against the valve-opening electromagnet 13 by the valve-opening coil spring 15 and supported by the valve-opening electromagnet 13.

In assembling the valve operating system $\mathbf{10}_1$ to the cylinder head 5, the pre-assembled unit U need only be assembled to the cylinder head 5 in a condition in which the engine valve V, the valve-closing coil spring 16 and the like have been assembled to the cylinder head 5, as shown in FIG. 4. The cap $\mathbf{57}_1$ that is fixed to the upper end of the stem 8 is inserted from below into the casing 11 and into the armature 12 so that it is engaged with the lower end of the armature 12, and the bolts 22 are installed through holes in casing 11 to engage the threaded holes in the cylinder head 5 to thereby urge the armature 12 upwards away from the valve-opening electromagnet 13. This completes the assembling of the valve operating system $\mathbf{10}_1$ and completes the attachment of the valve-operating system $10_1$ to the cylinder head 5. Thus, it is possible to enhance the assemblability of the valve operating system $10_1$.

In such valve operating system $10_1$, the resilient force of the valve-opening coil spring 15 is applied to the armature 12 and the resilient force of the valve-closing coil spring 16 is applied to the stem 8. When the armature 12 is attracted to the valve-closing electromagnet 14, the armature 12 and the stem 8 are can be moved relative to each other. Therefore, only the resilient force of the valve-closing coil spring 16 can be applied to the stem 8 of the engine valve V by only moving the armature 12 toward the valve-closing electromagnet 14 by energization of the valve-closing electromagnet 14, whereby when the engine valve V is seated, the seating force can be determined by the resilient force of the valve-closing coil spring 16 without need for a complicated control. As a result, the stable seating force for the engine valve V can be provided in such a manner that it can be determined by the valve-closing coil spring 16, irrespective of the elongation of the stem 8 and a variation in value of the current supplied to the valve-closing electromagnet 14.

The connecting means $56_1$ for operatively connecting the armature 12 and the stem 8 includes the bottomed cylindrical cap $57_1$ which is fixed to the upper end of the stem 8 so that it can be engaged with the armature 12 from the side opposite from the valve-closing electromagnet 14 and which is axially relatively slidably fitted into the armature 12. Thus, the armature 12 and the stem 8 can be moved in unison with each other until the engine valve V is seated on the valve seat member 6 upon the closing thereof, but after seating of the engine valve V, the armature 12 can be moved toward the valve-closing electromagnet 14. Therefore, the construction for cutting off the transmission of the force between the armature 12 and the stem 8 during closing of the engine valve V can be easily made, and the outer surface of the cap $57_1$ can be easily formed as a slide surface by machining.

Moreover, since the distance $L_3$ through which the armature 12 is moved toward the valve-closing electromagnet 14 after seating of the engine valve V is set at the value equal to or larger than the maximum amount of stem 8 elongated due to the thermal expansion of the engine valve V, it is possible to cope with the thermal expansion of the engine valve V to ensure the normal operation of the engine valve V when at an increased temperature.

Figure 5:
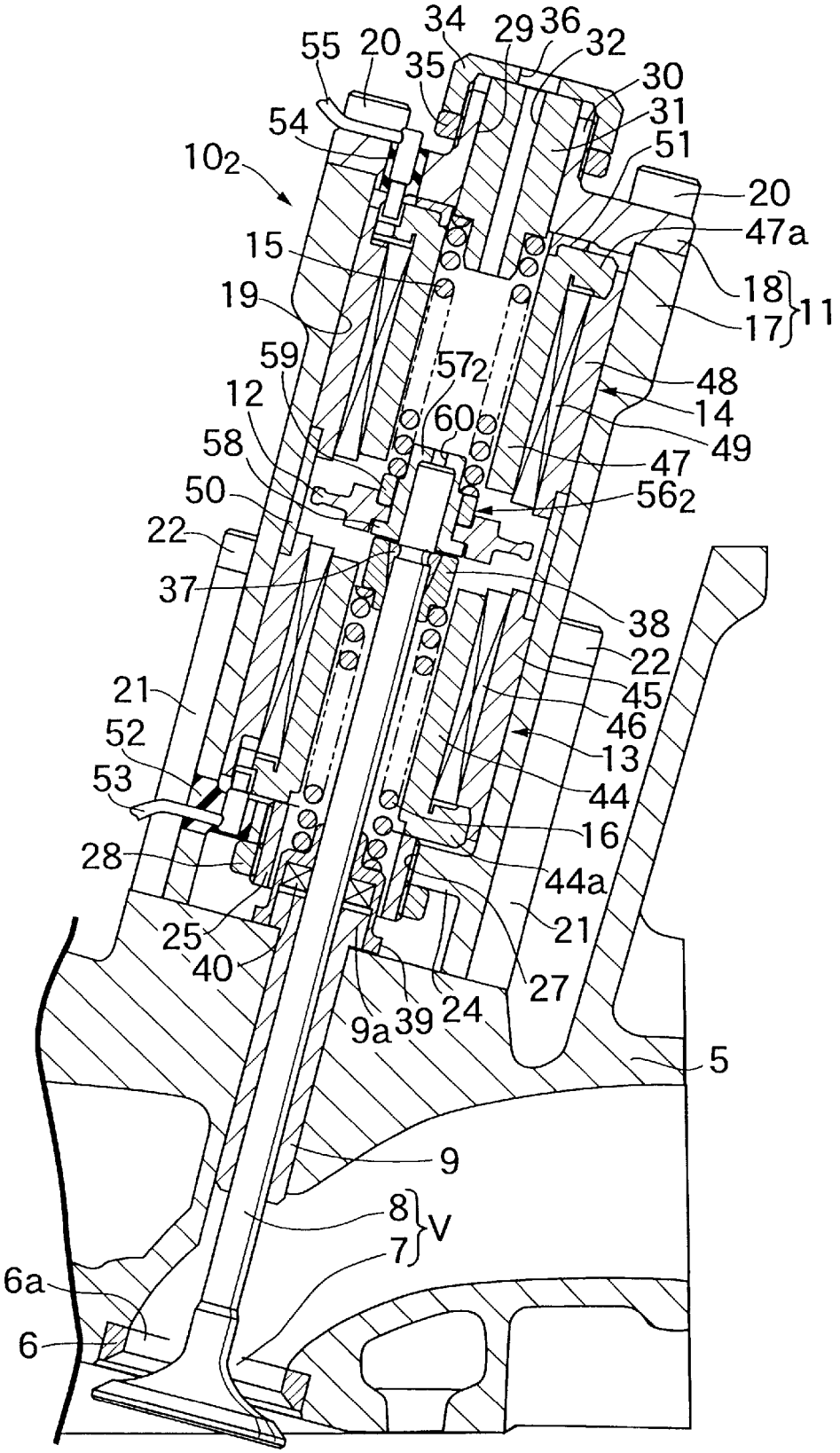
FIG. 5 is a vertical sectional view of a valve operating system according to a second embodiment in a condition in which an engine valve is in a neutral position.
Figure 6:
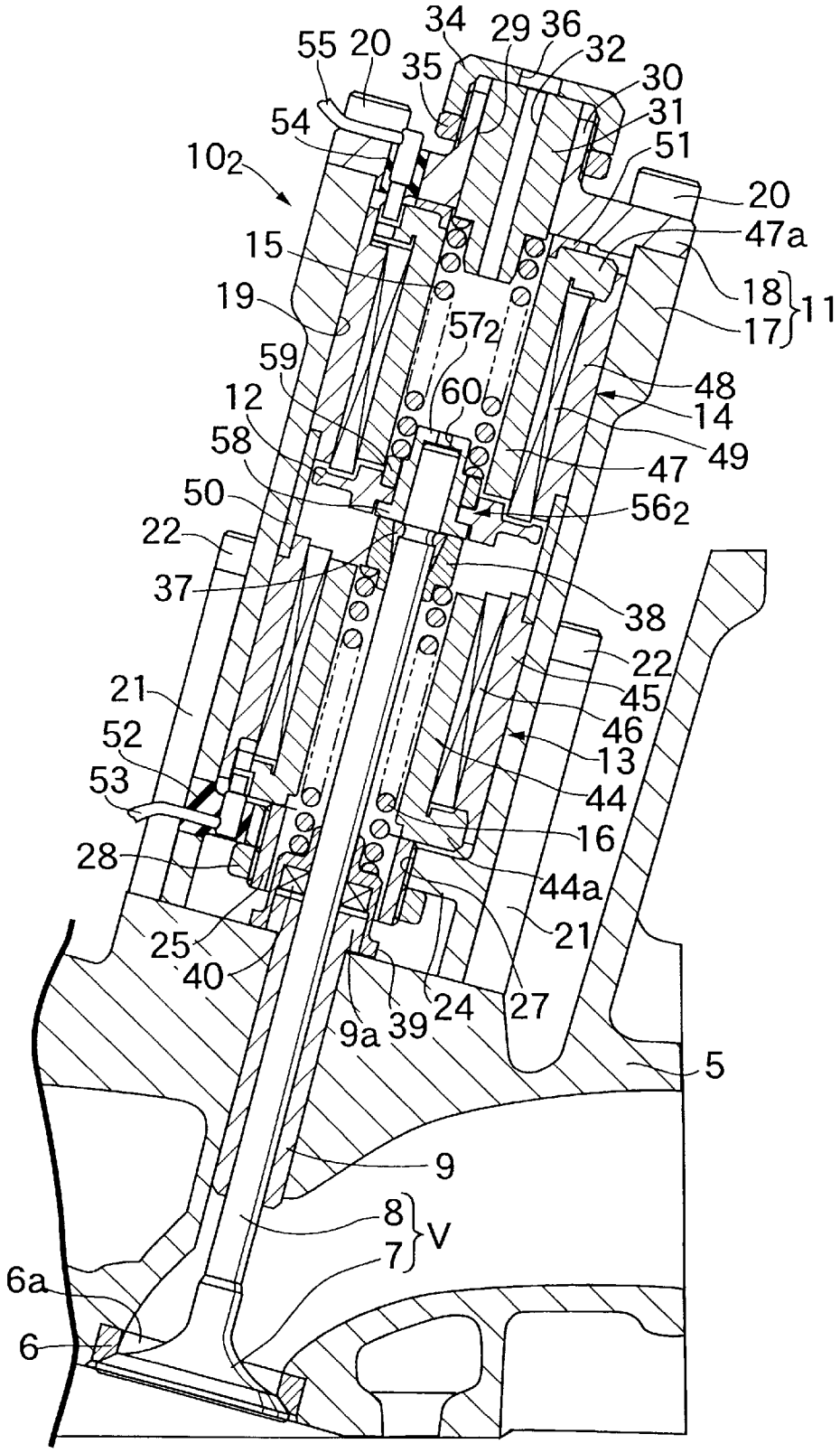
FIG. 6 is a vertical sectional view similar to FIG. 5, but in a condition in which the engine valve has been seated.
Figure 7:
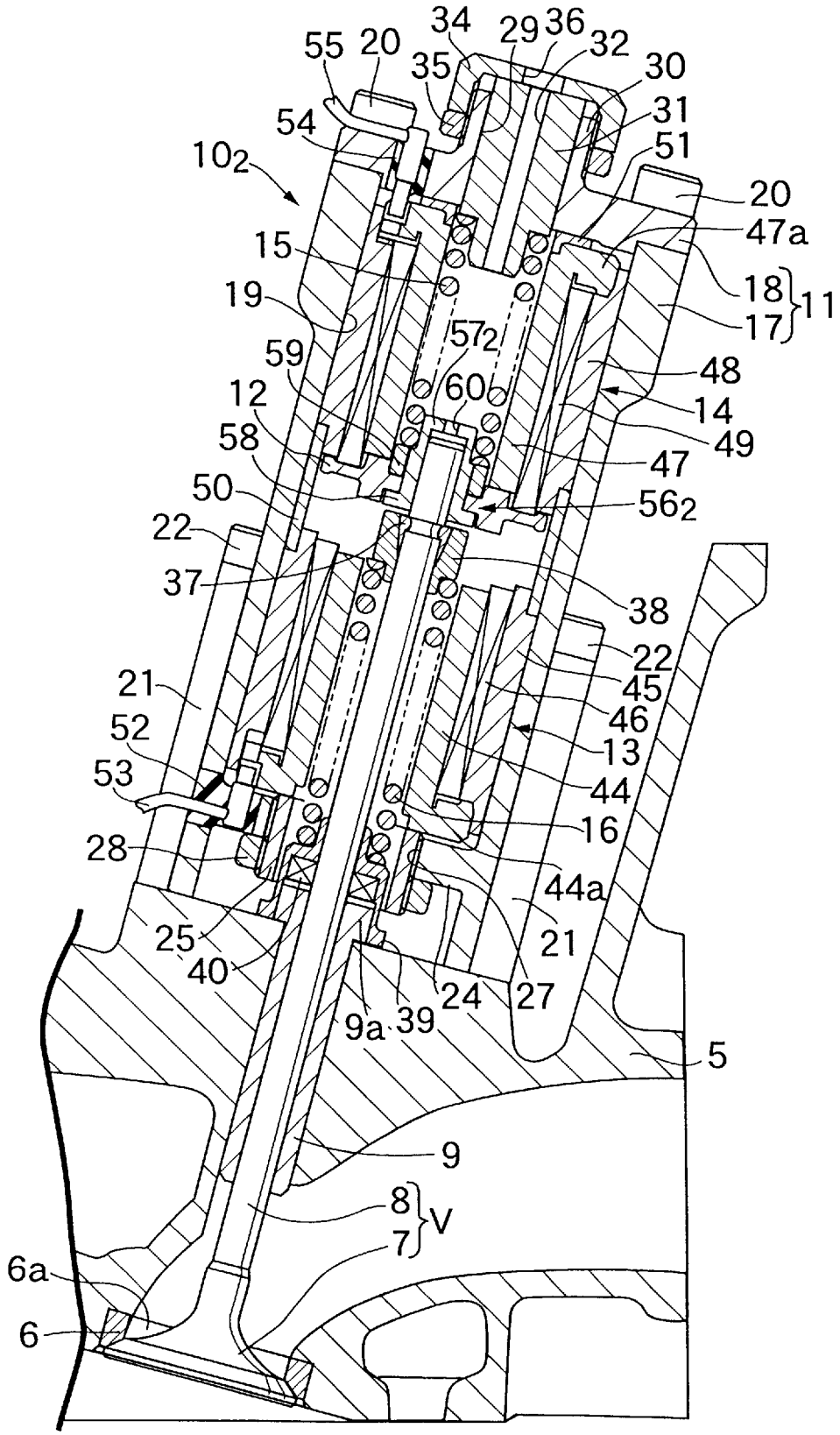
FIG. 7 is a vertical sectional view similar to FIG. 5, but in a condition in which an armature has been moved toward a valve-closing electromagnet after seating of the engine valve.

FIGS. 5 to 7 illustrate a second embodiment of the present invention. FIG. 5 is a vertical sectional view of a valve operating system in a condition in which an engine valve is in a neutral position; FIG. 6 is a vertical sectional view similar to FIG. 5, but in a condition in which the engine valve has been seated; and FIG. 7 is a vertical sectional view similar to FIG. 6, but in a condition in which an armature has been moved toward a valve-closing electromagnet after seating of the engine valve.

As is the valve-operating system $10_1$ of the first embodiment, the valve-operating system $10_2$ includes a casing 11, an armature 12 operatively connected to a stem 8 of an engine valve V, a valve-opening electromagnet 13 disposed within the casing 11 at a location in which it is opposed to a lower surface of the armature 12, a valve-closing electromagnet 14 disposed within the casing 11 at a location in which it is opposed to an upper surface of the armature 12, a valve-opening coil spring 15 for exhibiting a resilient force for biasing the engine valve V in an opening direction, and a valve-closing coil spring 16 for exhibiting a resilient force for biasing the engine valve V in a closing direction and for retaining the armature 12 at a predetermined neutral position by cooperation with the valve-opening coil spring 15 during deenergization of the valve-opening and valve-closing electromagnets 13 and 14. However, the construction of a connecting means $56_2$ provided between the stem 8 and the armature 12 is different from that in the first embodiment.

The connecting means $56_2$ includes a bottomed cylindrical cap $57_2$ which is fixed to the armature 12 and into which an upper portion of the stem 8 is slidably fitted. The cap $57_2$ is formed into a bottomed cylinder-like configuration having, at its opened end, an engage collar portion 58 capable of engaging the lower surface of the armature 12. The cap $57_2$ is fitted into a central portion of the armature 12. A portion of the cap $57_2$ protruding from the armature 12 is press-fitted into a ring 59 engaging the upper surface of the armature 12 and thus, the cap $57_2$ is fixed to the armature 12 in such a manner that the central portion of the armature 12 is clamped by the engage collar portion 58 and the armature 12. An opened bore 60 is provided in a closed end of the cap $57_2$.

According to the second embodiment, if the valve-closing electromagnet 14 is energized in a condition in which the engine valve V is in the neutral position, as shown in FIG. 5, the engine valve V is closed in response to attraction of the armature 12 toward the valve-closing electromagnet 14 and the biasing force of valve-closing coil spring 16, so that the valve member 7 of the engine valve V is seated on the valve seat member 6, as shown in FIG. 6. In this state, the cap $57_2$ and the armature 12 can be moved upwards, i.e., toward the valve-closing electromagnet 14 relative to the stem 8 of the engine valve V. With the continuation of the energization of the valve-closing electromagnet 14, the armature 12 and the cap $57_2$ are moved toward the valve-closing electromagnet 14, while the stem 8 remains in the same position. Thus, in a condition in which the armature 12 is in contact with the valve-closing electromagnet 14, as shown in FIG. 7, the spring force of the valve-opening coil spring 15 acting on the armature 12 as well as the electromagnetic force of the valve-closing electromagnet 14 are not applied to the stem 8, and only the spring force of the valve-closing coil spring 16 is applied to the stem 8, i.e., to the engine valve V.

As a result, as in the first embodiment, a stable seating force for the engine valve V can be provided in such a manner that it is determined only by the valve-closing coil spring 16, irrespective of an elongation of the stem 8 and a variation in value of current supplied to energize the valve-closing electromagnet 14.

Moreover, the connecting means $56_2$ includes the bottomed cylindrical cap $57_2$ which is fixed to the armature 12 and into which the upper end of the stem 8 is slidably fitted, and when the armature 12 is moved toward the valve-closing electromagnet 14 with the stem 8 remaining in the closed position, the cap $57_2$, i.e., the armature 12, is brought into a state in which it is supported on at the upper end of the stem 8. Therefore, it is possible to prevent any deflection of the armature 12 to stably attract the armature 12 toward the valve-closing electromagnet 14.

In addition, by the fact that the opened bore 60 is provided in the closed end of the cap $57_2$, it is possible to avoid the pressurization and depressurization of a space created between the cap $57_2$ and the stem 8 slidably fitted into the cap $57_2$, and to prevent the stem 8 from being attracted upwards, when the volume of the space during closing of the engine valve V is increased, thereby preventing an increase in seating force.

As discussed above, according to one aspect of the invention, when the engine valve is seated on the valve seat member, only the resilient force of the valve-closing resilient means is applied to the engine valve. Thus, it is possible to provide the stable seating force irrespective of the elongation of the stem and the variation in value of the current supplied to energize the valve-closing electromagnet.

According to another aspect of the invention, only the resilient force of the valve-closing resilient means is applied to the stem of the engine valve with a separate attraction of the armature to the valve-closing electromagnet by the energization of the valve-closing electromagnet. Therefore, it is possible to determine the seating force for the engine valve by the resilient force of the valve-closing resilient means without need for a complicated control.

According to still another aspect of the invention, after seating of the engine valve, the armature can be moved toward the valve-closing electromagnet with the stem remaining in the same position, and the transmission of the force from the armature can be cut of by the connecting means provided between the armature and the stem, so that the seating force can be provided by only the resilient force of the valve-closing, resilient means applied to the stem.

According to a further aspect of the invention, by the fact that the bottomed cylindrical cap that is fixed to the upper end of the stem to become engaged with the armature from the side opposite from the valve-closing electromagnet is fitted into the armature for axial relative sliding movement, the outer peripheral surface of the cap can be easily formed as a slide surface by machining.

According to a still further aspect of the invention, by the fact that the upper portion of the stem is slidably fitted into the cap fixed to the armature, the cap, i.e., the armature, is in a state in which it is supported by the upper portion of the stem during movement of the armature toward the valve-closing electromagnet. Thus, it is possible to prevent any deflection of the armature to stably attract the armature to the valve-closing electromagnet.

According to another feature of the invention, the distance through which the armature is moved toward the valve-closing electromagnet after seating of the engine valve is set at a value equal to or larger than the maximum amount in elongation of the stem due to the thermal expansion of the engine valve. Thus, it is possible to cope with the thermal expansion of the engine valve to ensure the normal operation of the engine valve at an increased temperature.

According to still another feature of the invention, it is possible to avoid the pressurization and depressurization of the space created between the cap and the stem slidably fitted in the cap, and to prevent the stem from being attracted upwards when the volume of the space is increased during closing of the engine valve, thereby preventing an increase in seating force.

Although the embodiments of the present invention have been described in detail, it will be understood that the present invention is not limited to the above-described embodiments, and various modifications in design may be made without departing from the spirit and scope of the invention defined claims.

What is claimed:

1. A valve operating system in an internal combustion engine, comprising a valve seat member mounted in a cylinder head to define a valve bore, an armature operatively connected to a stem of an engine valve capable of being seated on said valve seat member, a valve-opening electromagnet for exhibiting an electromagnetic force of attracting said armature to open the engine valve, a valve-closing electromagnet for exhibiting an electromagnetic force for attracting said armature to close the engine valve, a valve-opening resilient means for exhibiting a resilient force for biasing said engine valve in an opening direction, a valve-closing resilient means for exhibiting a resilient force for said engine valve in a closing direction and for retaining said armature in a predetermined neutral position by cooperation with said valve-opening resilient means during deenergization of said valve-opening and valve-closing electromagnets, and a bottomed cylindrical cap mounted on said stem and engaging said armature, wherein said valve-operating system is constructed so that only the resilient force of the valve-closing resilient means is applied to said engine valve when said engine valve is seated on the valve seat member, and wherein said armature and said stem are operatively interconnected through a connecting means which is adapted to enable said armature and said stem to be moved in unison with each other during closing of said engine valve until the engine valve is seated on the valve seat member, but to permit the armature to be moved a distance toward said valve-closing electromagnet in the axial direction relative to said stem after stoppage of the movement of said stem as a result of seating of said engine valve.

2. A valve operating system in an internal combustion engine according the claim 1, wherein the resilient force of said valve-opening resilient means is applied to said armature for stopping the application of the valve-opening resilient force to said engine valve by an attraction of said armature toward said valve-closing electromagnet and away from the stem, and the resilient force of said valve-closing resilient means is applied to the stem which remains in a valve-seated position while said armature is being axially moved relative to said stem during attraction of said armature toward said valve-closing electromagnet.

3. A valve operating system in an internal combustion engine according to claim 2, wherein said bottomed cylindrical cap is fixed to an upper end of said stem, said bottomed cylindrical cap being engaged with said armature from a side opposite from said valve-closing electromagnet and being fitted into said armature for axial relative sliding movement.

4. A valve operating system in an internal combustion engine according to claim 2, wherein said bottomed cylindrical cap is formed into a bottomed cylinder-like configuration and fixed to said armature and into which an upper portion of said stem is slidably fitted and engages a bottomed end of said cap.

5. A valve operating system in an internal combustion engine according to claim 3 or 4, wherein the distance through which the armature is moved toward said valve-closing electromagnet after seating of said engine valve is set a value equal to or larger than the maximum amount in elongation of said stem due to the thermal expansion of said engine valve.

6. A valve operating system in an internal combustion engine according to claim 4, wherein said cap has an opened bore in said bottomed end.

7. A valve operating system in internal combustion engine, comprising an engine valve movable between open and closed positions by a valve-opening electromagnet and a valve-closing electromagnet respectively, a valve-opening spring for biasing said engine valve in an opening direction, a valve-closing spring for biasing said engine valve in a closing direction, an armature operatively connected to said engine valve and movable in response to selective energization of said electromagnets for selectively applying a force to said engine valve in an opening direction during valve opening movement and relieving the valve-opening spring biasing force from said engine valve in a closing direction during valve closing movement, and a bottomed cylindrical cap mounted on said stem in a manner for directly applying a valve-opening force from said cap to said stem, said armature mounted on said cap in a manner for directly applying a valve-opening force from said armature to said cap, said cap and said armature including means for allowing movement of said armature relative to said stem in a valve-closing direction to cause only the resilient force of the valve-closing resilient means to be applied to said engine valve when said engine valve is seated on the valve seat member and to cause the armature to move toward said valve-closing electromagnet relative to said stem after said seating of said engine valve.

8. A valve operating system in an internal combustion engine, comprising a valve seat member mounted in a cylinder head to define a valve bore, an armature operatively connected to a stem of an engine valve capable of being seated on said valve seat member, a valve-opening electromagnet for exhibiting an electromagnetic force of attracting said armature to open the engine valve, a valve-closing electromagnet for exhibiting an electromagnetic force for attracting said armature to close the engine valve, a valve-opening resilient means for exhibiting a resilient force for biasing said engine valve in an opening direction, a valve-closing resilient means for exhibiting a resilient force for biasing said engine valve in a closing direction and for retaining said armature in a predetermined neutral position by cooperation with said valve-opening resilient means during deenergination of said valve-opening and valve-closing electromagnets, and a bottomed cylindrical cap mounted on said stem in a manner for directly applying a valve-opening force from said cap to said stem, said armature mounted on said cap in a manner for directly applying a valve-opening force from said armature to said cap, said cap and said armature including means for allowing movement of said armature relative to said stem in a valve-closing direction to cause only the resilient force of the valve-closing resilient means to be applied to said engine when said engine valve is seated on the valve seat member and to cause the armature to move toward said valve-closing electromagnet relative to said stem after said seating of said engine valve.

* * * * *